US008474089B2

(12) United States Patent
Goentzel

(10) Patent No.: US 8,474,089 B2
(45) Date of Patent: Jul. 2, 2013

(54) CLEANING BUCKET SYSTEM FOR FLAT MOPS

(76) Inventor: Howard Goentzel, Palmer, AK (US)

( * ) Notice: Subject to any disclaimer, the term of this patent is extended or adjusted under 35 U.S.C. 154(b) by 372 days.

(21) Appl. No.: 12/804,690

(22) Filed: Jul. 27, 2010

(65) Prior Publication Data

US 2012/0152277 A1 Jun. 21, 2012

(51) Int. Cl.
*A47L 13/14* (2006.01)
*A47L 13/58* (2006.01)

(52) U.S. Cl.
USPC ..... 15/260; 15/264

(58) Field of Classification Search
USPC ..... 15/160, 161, 164, 260, 261, 264
See application file for complete search history.

(56) References Cited

U.S. PATENT DOCUMENTS

| | | | | |
|---|---|---|---|---|
| 4,161,799 | A * | 7/1979 | Sorrells | 15/260 |
| 4,493,492 | A * | 1/1985 | Balabanova | 280/651 |
| 6,173,472 | B1 * | 1/2001 | McLaughlin et al. | 15/260 |
| 2003/0046782 | A1 * | 3/2003 | Kresse et al. | 15/229.8 |

* cited by examiner

*Primary Examiner* — Saeed T Chaudhry
(74) *Attorney, Agent, or Firm* — Michael J. Tavella

(57) ABSTRACT

A double bucket system for flat mops that is mounted in a frame. One bucket contains only clean water. The second bucket is used to hold dirty water. The second bucket has a special fixture attached that the user slides the mop through. The frame compresses the mop as it slides through, which ensure complete, even pressing of the mop to extract the greatest amount of dirty water. The frame includes footpads upon which the user stands during the pressing operation. This ensures that the device remains in place during the pressing. Finally, once the mop has been thoroughly pressed, the user can pick up clean water from the first bucket for the next portion of the floor to be cleaned. In this way, the user is able to quickly clean a large floor with clean water instead of repeatedly dipping the mop back into dirty water.

8 Claims, 10 Drawing Sheets

CLEANING BUCKET SYSTEM FOR FLAT MOPS

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the invention

This invention relates to bucket systems for mops and particularly to bucket systems for flat mops.

2. Description of the Prior Art

Mops have been used for centuries. Currently, commercial cleaners often prefer flat mops, such as the microfiber flat mops by 3M corporation. These mops have a flat pad that absorbs and holds water very similar to the old string type mops. However, the flat design allows the user to cover more floor space. The flat pad also has other advantages over the old style of mops. Currently, these mops are cleaned by pressing them against a plate in a specially designed bucket that fits the mops. An example of this bucket is shown in FIG. 1. The user dips the mop into the lower portion of the bucket 100 to wet the mop. After mopping a section of floor, the user then presses the mop against the plate 101 to press out the water. There are several problems with this design. First, there is little stability in the bucket. Pressing too hard on the plate can cause the bucket to tip backwards. Also, there is no way to restrain the bucket when it is being used. The wheels 102 are not easily secured. As a result, there is a high probability that the pad will not be thoroughly pressed out before the next use. Finally, and perhaps the biggest problem is that the user must press out the dirty water from the mop back into the same bucket the user is using for cleaning. Thus, after only a short while the user is left with a bucket full of dirty water. This requires frequent empting and refilling of the bucket to keep the floor clean.

BRIEF DESCRIPTION OF THE INVENTION

The instant invention overcomes all these problems. It is a double bucket system that is mounted in a frame. One bucket contains only clean water. The second bucket is used to hold dirty water. The second bucket has a special fixture attached that the user slides the mop through. The frame compresses the mop as it slides through, which ensure complete, even pressing of the mop to extract the greatest amount of dirty water. The frame includes footpads upon which the user stands during the pressing operation. This ensures that the device remains in place during the pressing. Finally, once the mop has been thoroughly pressed, the user can pick up clean water from the first bucket for the next portion of the floor to be cleaned. In this way, the user is able to quickly clean a large floor with clean water, instead of repeatedly dipping the mop back into dirty water.

DETAILED DESCRIPTION OF THE INVENTION

Figure 1:
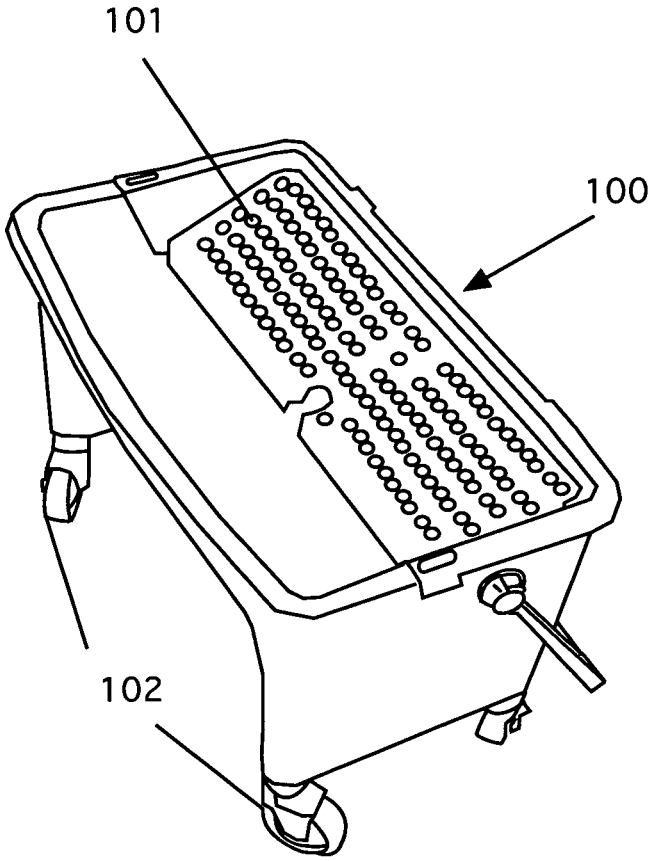
Figure 1 Prior Art
FIG. 1 is a perspective view of a flat mop bucket as prior art.
Figure 2:
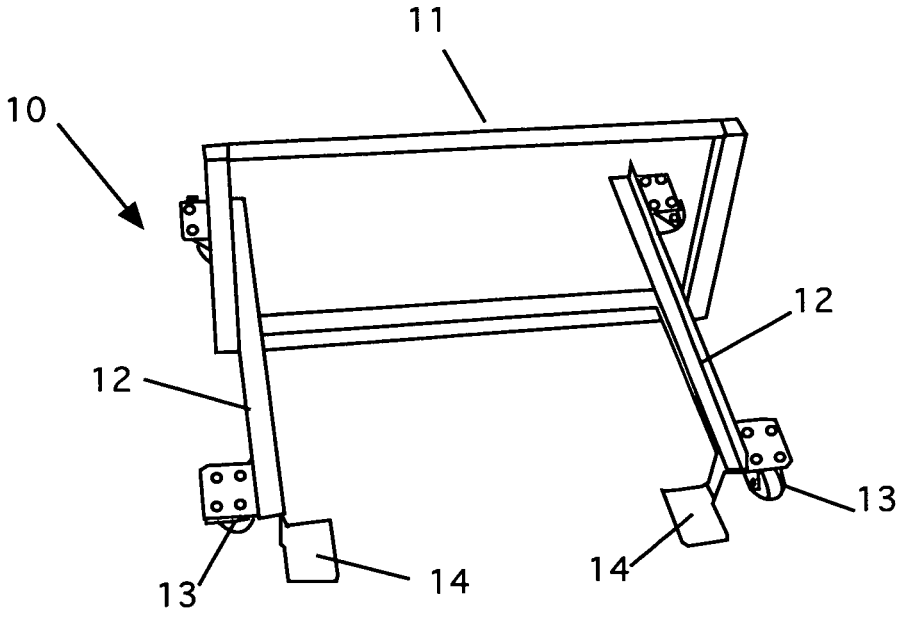
FIG. 2 is a front perspective view of the bucket frame.
Figure 3:
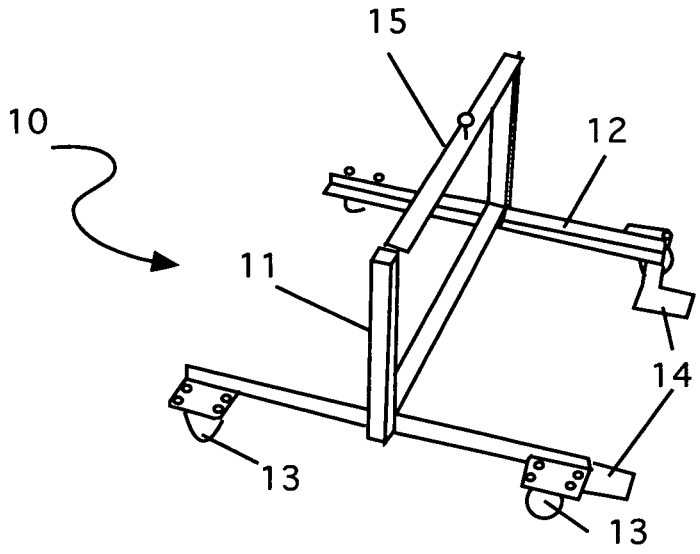
FIG. 3 is a side perspective view of the bucket frame with the bucket retainer installed.
Figure 4:
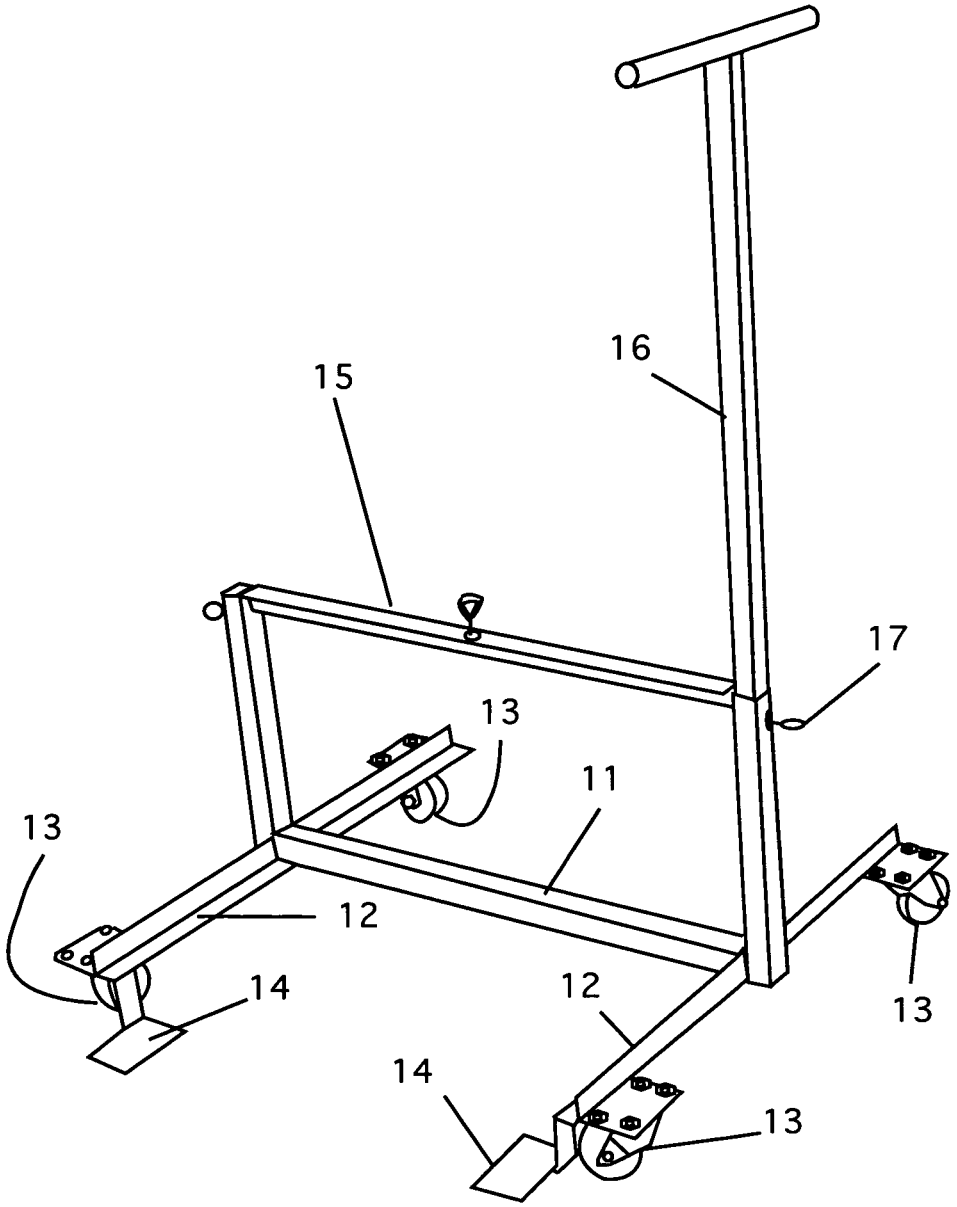
FIG. 4 is a side perspective view of the bucket frame with the bucket retainer and handle installed.

Referring now to FIG. 2-4, the bucket frame 10 is shown. The frame is made of aluminum to save weight. It has a rectangular upright portion 11 and two wheel arms 12. The wheel arms are attached to the rectangular frame as shown. Each wheel arm has a pair of castors 13 attached that allows the frame to be easily moved. The wheel arms also have footpads 14 on the mop cleaning side of the frame. These footpads allow a user to stand on the footpads during the mop sliding operation to prevent the device from moving. See FIG. 11. FIG. 3 shows the bucket retainer plate 15 attached. This plate is used to hold the buckets in the frame for use. A bolt 19 is used to secure the plate to the frame. FIG. 4 is a side perspective view of the bucket frame with the bucket retainer and handle installed. Here, a handle 16 is installed in one of the uprights of the upright portion. A bolt 17 is used to secure the handle in place. The handle allows a user to move the unit without having to bend.

Figure 5:
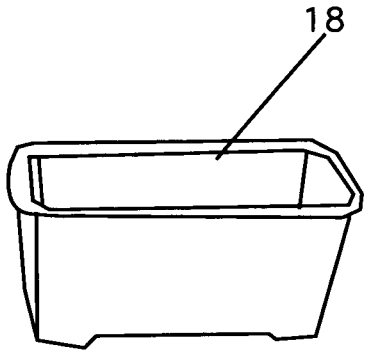
FIG. 5 is a front perspective view of one of the wash buckets as part of this invention.
Figure 6:
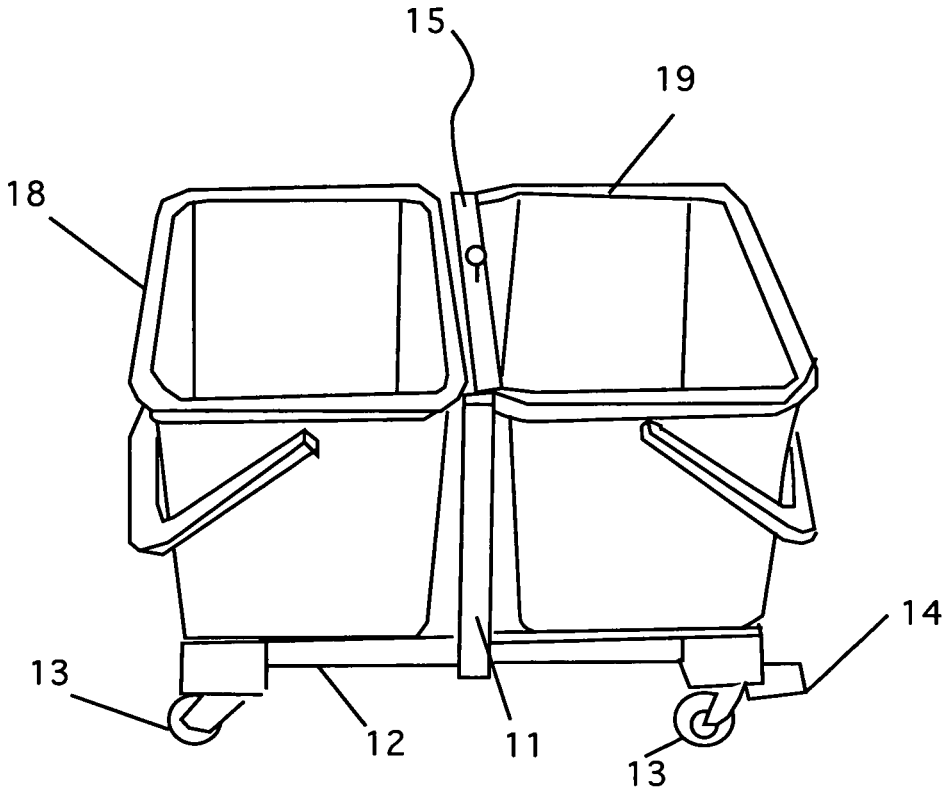
FIG. 6 is a side perspective view of the bucket frame with two buckets installed.

FIG. 5 is a front perspective view of one of the wash buckets as part of this invention. The invention uses two large plastic wash buckets 18. The buckets are sized to accommodate a flat mop. FIG. 6 is a side perspective view of the bucket frame with two buckets installed. In the preferred embodiment, the unit uses two wash buckets 18. One of the buckets is used to hold clean water. The second is used to hold the dirty water that is collected after the mop is used. The buckets are mounted in the frame as shown and are secured with the bucket plate 15, which is locked down with a bolt 19.

Figure 7:
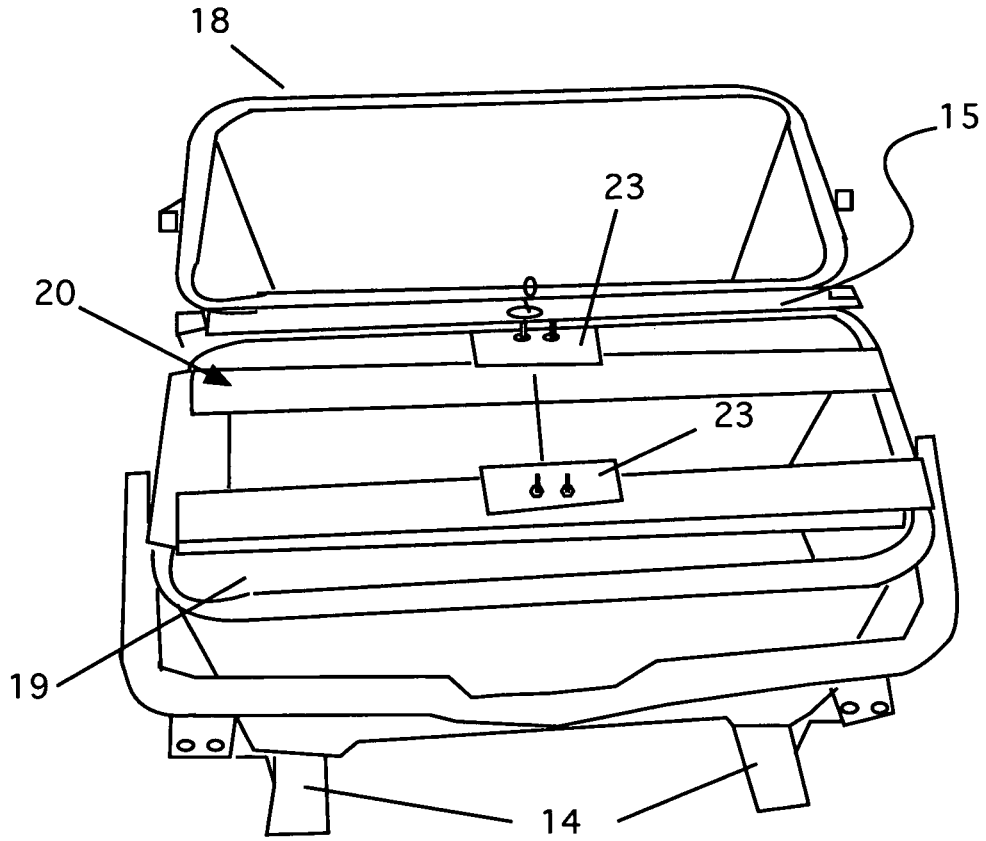
FIG. 7 is a top perspective view of the bucket frame with two buckets and the mop slider installed.
Figure 8:
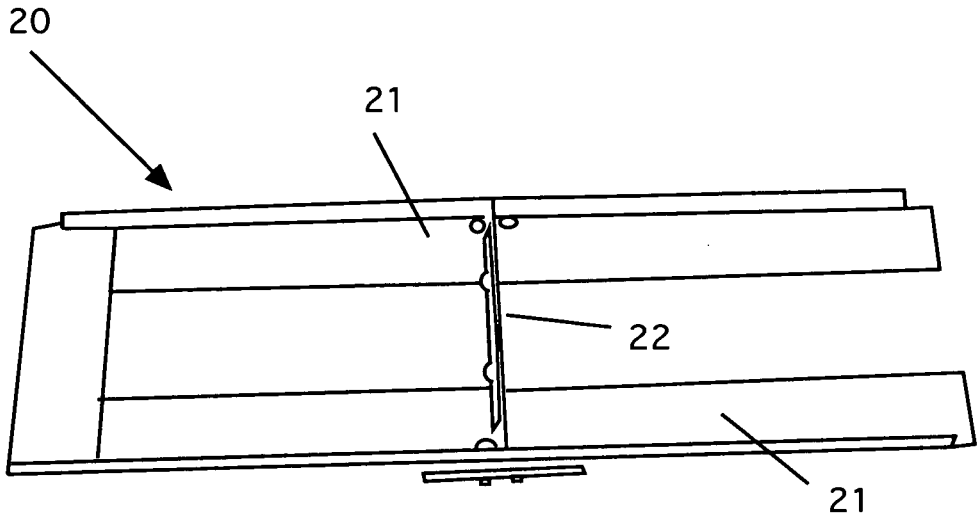
FIG. 8 is a bottom perspective view of the mop slider.

FIG. 7 is a top perspective view of the bucket frame with two buckets and the mop slider installed. In this figure, the dirty water bucket has the mop slider 20 installed. The key to this device is the mop slider installed. This slider is designed to fit atop the bucket and has lower flanges 21 and a center rib 22 that engage the side walls of the bucket to hold it in place. These flanges and rib are shown in FIG. 8, which is a bottom perspective view of the mop slider 20.

Figure 9:
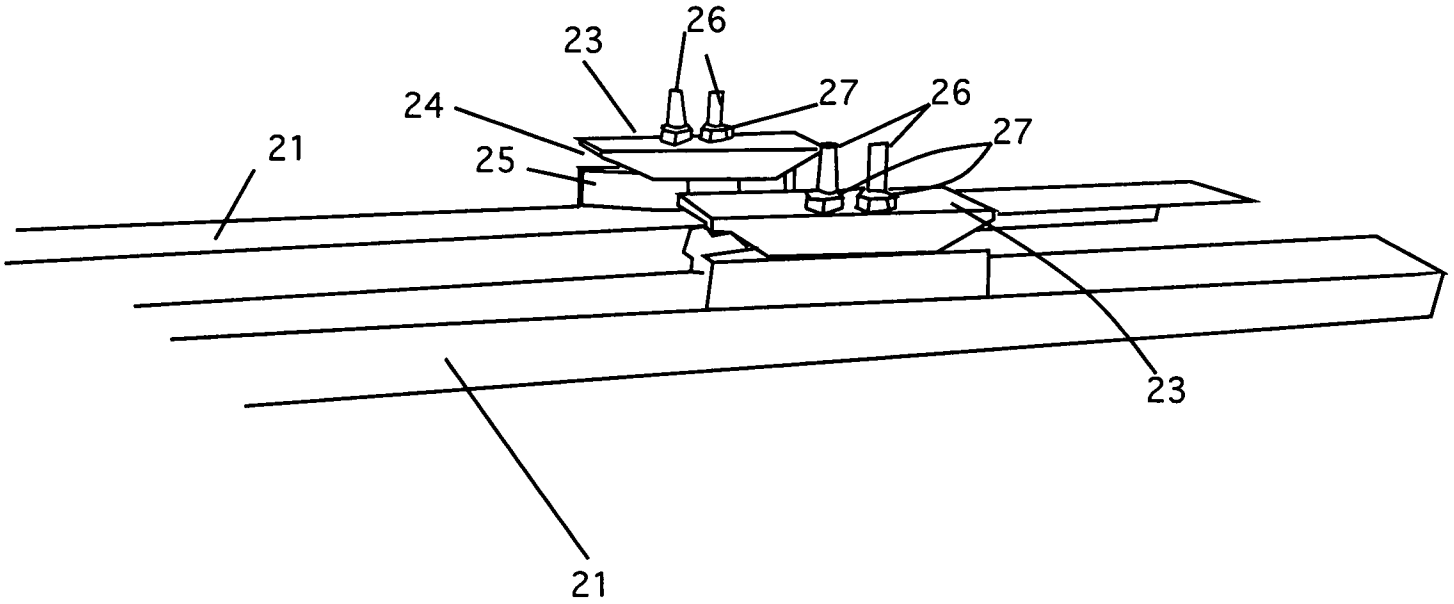
FIG. 9 is a detail view of the pressure blocks on the mop slider.

The mop slider 20 has a pair of pressure blocks 23 attached. FIG. 9 is a detail view of the pressure blocks 23 on the mop slider. The pressure blocks 23 have angled sides 24 and side pads 25 that squeeze the mop pad as it is being moved through the slider. The pressure of the blocks is controlled by bolts 26 and nuts 27 that are attached to the blocks as shown.

Figure 10:
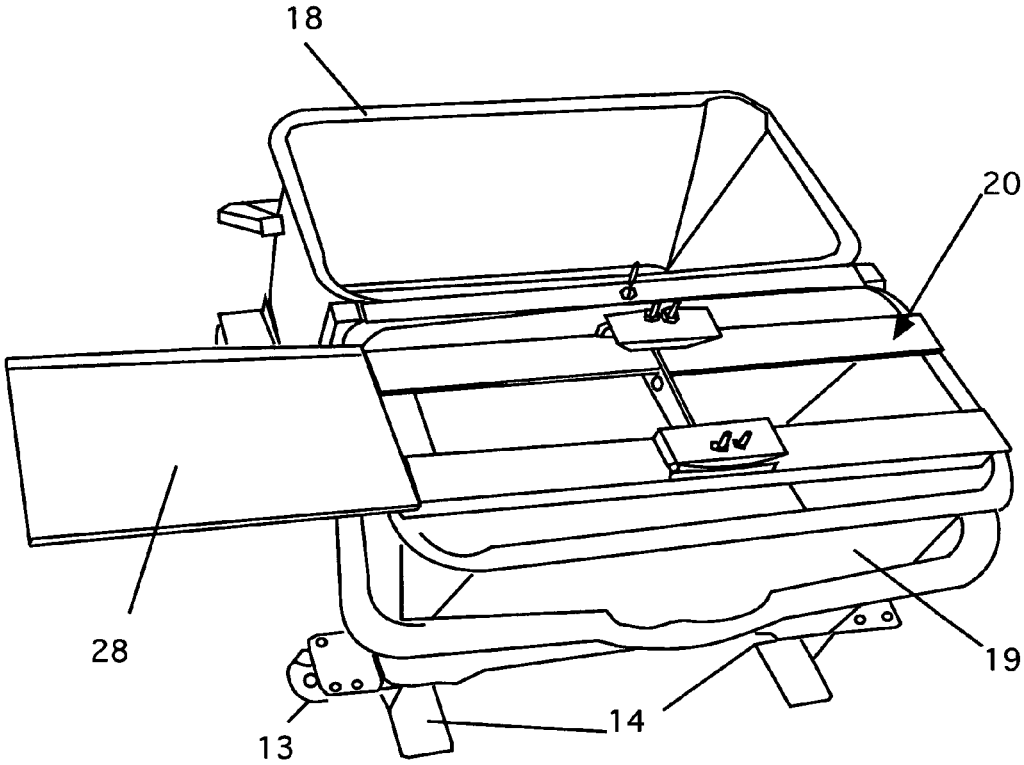
FIG. 10 is a top perspective view of the bucket frame with two bucket, the mop slider, and the mop wiping plate installed.

FIG. 10 is a top perspective view of the bucket frame with two buckets, the mop slider, and the mop wiping plate installed. At one end of the mop slider is a plate 28 that can be attached. This plate is used to wipe the bottom of the mop after it has passed through the slider to ensure that it is completely clean.

Figure 11:
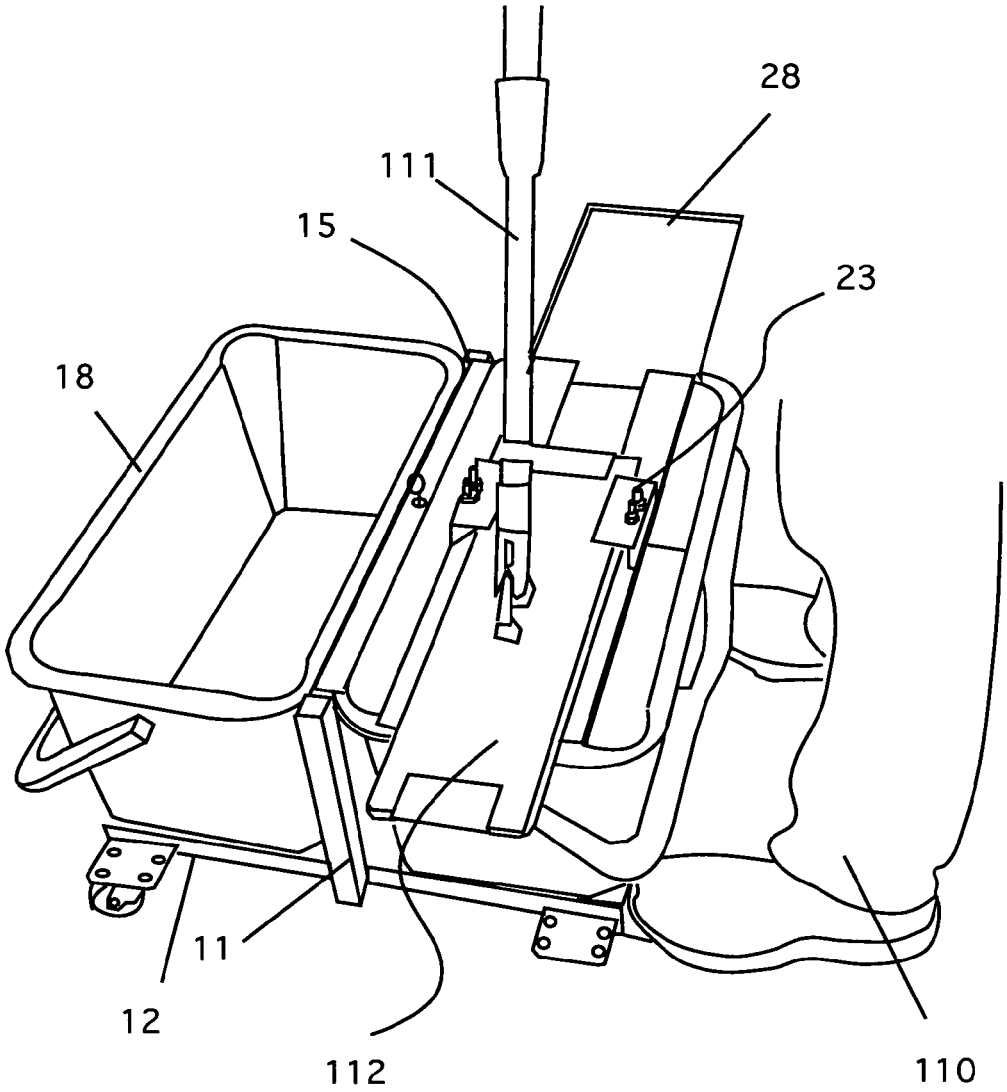
FIG. 11 is a detail view of a flat mop being slid in the mop slider during a cleaning operation.

FIG. 11 is a detail view of a flat mop being slid in the mop slider during a cleaning operation. Here, the user 110 stands on the footpads 14 and holds the mop handle 111. The mop 112 is shown in the slider. The user pushed the mop through the slider in the direction of the arrow. Once the mop is completely through the slider, it passes over the end plate 28. Once clean, the user can rewet the mop with clean water from the second bucket 18*a*. In this way, the mopping operation is kept simple and efficient in that the user has an easy way to clean the mop and always has a ready source of clean water to continue the mopping operation. The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A cleaning bucket system for flat mops comprising:

a) a frame having a vertical center portion, having a top and a bottom, and a pair of support arm extending from the bottom of said vertical portion;

b) a plurality of casters attached to said pair of support arms;

c) a pair of foot pads attached to said pair of support arms;

d) a pair of cleaning buckets each of said pair of buckets having a top perimeter, positioned on said frame such that the vertical center portion is centered between said pair of cleaning buckets; and e) a mop slider, having two ends, positioned atop one of said pair of cleaning buckets such that said two ends overhang the top perimeter of the one of said pair of cleaning buckets and extend outward in horizontal plane;

f) said mop slider also having a pair of compression blocks, positioned above one of said pair of cleaning buckets such that when a flat mop is pushed laterally across said mop slider from one end of said mop slider to the other end of said mop slider while remaining outside of the bucket, dirty water contained in said flat mop is discharged into the one of said pair of cleaning buckets.

2. The cleaning bucket system of claim 1 further comprising a means for securing said pair of buckets onto said frame.

3. The cleaning bucket system of claim 2 wherein the means for securing said pair of buckets onto said frame comprises:

a) a bar placed atop the vertical center portion, said bar having a width sufficient to engage both of said pair of cleaning buckets; and b) a means for securing said bar to said frame.

4. The cleaning bucket system of claim 3 wherein the means for securing said bar to said frame comprises a bolt.

5. The cleaning bucket system of claim 1 wherein one of said pair of cleaning buckets holds clean water.

6. The cleaning bucket system of claim 1 further comprising an upright handle, removably attached to said vertical center portion of said frame.

7. The cleaning bucket system of claim 1 wherein the mop slider further comprises a flat plate, attached to one end of said mop slider.

8. The cleaning bucket system of claim 1 wherein the mop slider has an open center portion.

* * * * *